US008257072B2

(12) United States Patent
Shimaguchi et al.

(10) Patent No.: US 8,257,072 B2
(45) Date of Patent: Sep. 4, 2012

(54) VANE COMPRESSOR WITH IMPROVED VANES

(75) Inventors: Hirotada Shimaguchi, Kuki (JP); Yoshinobu Maemura, Saitama (JP)

(73) Assignee: Calsonic Kansei Corporation, Saitama-shi (JP)

( * ) Notice: Subject to any disclaimer, the term of this patent is extended or adjusted under 35 U.S.C. 154(b) by 916 days.

(21) Appl. No.: 12/342,766

(22) Filed: Dec. 23, 2008

(65) Prior Publication Data

US 2009/0162234 A1 Jun. 25, 2009

(30) Foreign Application Priority Data

| | | |
|---|---|---|
| Dec. 25, 2007 | (JP) | 2007-332645 |
| Jan. 24, 2008 | (JP) | 2008-013937 |
| Feb. 29, 2008 | (JP) | 2008-051092 |
| Mar. 17, 2008 | (JP) | 2008-067743 |

(51) Int. Cl.
*F01C 1/00* (2006.01)
*F04C 2/00* (2006.01)

(52) U.S. Cl. ..... 418/266

(58) Field of Classification Search ..... 418/266
See application file for complete search history.

(56) References Cited

U.S. PATENT DOCUMENTS

| | | | | | |
|---|---|---|---|---|---|
| 508,555 | A | * | 11/1893 | Petty | 418/266 |
| 582,280 | A | * | 5/1897 | Goodwin et al. | 418/266 |
| 1,628,058 | A | * | 5/1927 | Nix | 418/266 |
| 1,913,758 | A | * | 6/1933 | Hapkins | 418/266 |
| 4,428,195 | A | * | 1/1984 | Linder et al. | 418/266 |

FOREIGN PATENT DOCUMENTS

| | | | |
|---|---|---|---|
| JP | 51-154405 | U | 12/1976 |
| JP | 52-093905 | U | 7/1977 |
| JP | 55-104502 | A | 8/1980 |
| JP | 55-140782 | U | 10/1980 |
| JP | 8-538 | Y2 | 1/1996 |
| JP | 2007-100602 | A | 4/2007 |

* cited by examiner

*Primary Examiner* — Mary A Davis
(74) *Attorney, Agent, or Firm* — Foley & Lardner LLP

(57) ABSTRACT

A vane-type compressor includes: a cylinder block; a rotor rotating within the cylinder block; vane slots provided on the rotor; vanes each provided slidably within each of the vane slots; coil springs provided within the vane slots for pushing the vanes; guide pins each provided along each of the coil springs and directly fixed on the vanes or the rotor; and guide holes each provided for each of the guide pins and formed on the rotor or the vane. The guide holes are formed on the vanes in case where the guide pins are directly fixed on the rotor. Alternatively, the guide holes are formed on the rotor in case where the guide pins are directly fixed on the vanes. The compressor prevents chattering of the vanes and also prevents a complex structure and cost rise.

2 Claims, 11 Drawing Sheets

VANE COMPRESSOR WITH IMPROVED VANES

BACKGROUND OF THE INVENTION

1. Field of the Invention

The present invention relates to a compressor to compress refrigerant using compression chambers formed within a cylinder block by a rotor and vanes rotating within the cylinder block.

2. Description of Related Art

An air compressor is disclosed in Japanese Patent Application Laid-Open No. 2007-100602 (Patent Document 1). The compressor is a vane-type compressor. Generally in a vane-type compressor, an oil pressure (back pressure) pressured by a discharge pressure is supplied to vane slots provided in a rotor. Vanes in the vane slots are pressed toward an inner surface (cam face) of compression chambers in a cylinder block due to this back pressure. As a result, activation of compression is improved and chattering between the vanes and the cam face is reduced.

In the above air compressor, additional high-pressure supply paths are provided in addition to commonly used back-pressure supply paths. The additional high-pressure supply paths are changed over from the back-pressure supply paths by spring-driven valves to restrict reduction of a chattering prevention function at activation where the discharge pressure (back pressure) is insufficient.

In addition, a vane pump is disclosed in Examined Japanese Utility Model Application Publication No. Hei 8-538 (Patent Document 2). In the vane pump, coil springs are provided for pushing vanes chattering is prevented by the coil springs in addition to the above-mentioned back pressure. In addition, guide pins are inserted in to the coil springs to prevent serpentine flections of the coil springs being compressed. The guide pins are shorter than the coil springs being extended. If the coil springs serpentine when being compressed, reciprocating of the vanes may be inhibited. The guide pins are attached in vane slots with interposing support plates.

SUMMARY OF THE INVENTION

However, with respect to the above air compressor, the additional high-pressure supply paths and the spring-driven valves are needed to be added to prevent chattering. Therefore, it should have a complex structure and its cost rises.

In addition, with respect to the above vane pump, the guide pins are shorted than the coil springs. Therefore, the coil springs are not guided sufficiently by the guide pins when the coil springs extend longer than the guide pins. Thereby, the coil springs may bow toward a radial direction (serpentine).

Furthermore, the support plates are used for attaching the guide pins. Therefore, number of components increases and its cost rises.

Therefore, desired is a vane-type compressor that doesn't need additional high-pressure supply paths or spring-driven valves for prevention of chattering and can prevent a complex structure and cost rise. In addition, desired is a vane-type compressor that can prevent misalignment of coil springs being extended, extra components for fixing the coil springs, component incrementation and cost rise.

An aspect of the present invention provides a vane-type compressor that includes: a cylinder block; a rotor rotating within the cylinder block; a plurality of vane slots provided on an outer surface of the rotor and extending inwardly; a plurality of vanes each provided slidably within each of the plurality of vane slots and reciprocating as to contact a top end thereof onto an inner surface of the cylinder block along with the rotor rotating; a plurality of coil springs provided within the plurality of vane slots for pushing the plurality of vanes toward the inner surface; a plurality of guide pins each provided along each of the plurality of coil springs and directly fixed on the plurality of vanes or the rotor; and a plurality of guide holes each provided for each of the plurality of guide pins and formed on the rotor or the plurality of vanes. The plurality of guide holes is formed on the plurality of vanes in case where the plurality of guide pins is directly fixed on the rotor. Alternatively, the plurality of guide holes is formed on the rotor in case where the plurality of guide pins is directly fixed on the plurality of vanes.

According to the vane-type compressor, since the guide pins are directly fixed onto the vanes or the rotor, component incrementation and cost rise can be prevented. In addition, reliability can be also improved. Further, since each of the guide pins is being inserted within each of the guide holes at least partly, the vanes are guided firmly. Furthermore, since each of the guide pins is provided along each of the guide pins, serpentine flections of the coil springs is prevented firmly by the guide pins and thereby the vanes can reciprocate firmly.

It is preferable that the plurality of the guide pins is directly fixed on the rotor and the plurality of guide holes is formed on the plurality of vanes, and the plurality of coil springs contacts with base ends of the plurality of vanes and does not enters into the plurality of guide holes.

According to this configuration, additional high-pressure supply paths and spring-driven valves are not necessary and thereby a complex structure and cost rise can be prevented. In addition, serpentine flections of the coil springs being compressed can be prevented by the guide pins.

In addition, it is preferable that each of the plurality of guide pins is provided within each of the coil springs, and is longer than each of the plurality of coil springs under a most extending condition.

According to this configuration, serpentine flections of the coil springs being compressed can be prevented by the guide pins. In addition, since the guide pins are longer than the extended coil springs, misalignment of the coil springs in their radial direction can be prevented.

Further, it is preferable that the plurality of guide pins is fixed on bottoms of the plurality of vane slots. Especially, it is preferable that the plurality of guide pins is press-fitted onto the bottoms of the plurality of vane slots.

According to these configurations, any extra component is not necessary and thereby component incrementation and cost rise can be prevented.

Meantime, since each inner circumference of the coil springs contacts with each outer circumference of the guide pins in the vane pump disclosed in the Patent Document 2, both may be worn away. Especially, since stress is focused on the inner circumference in the coil springs, alteration of its spring constant or breakage may occur due to attrition of the inner circumference. Prevention of attrition and breakage of the coil springs is further desired.

Therefore, it is preferable that the plurality of the guide pins is directly fixed on the rotor and the plurality of guide holes is formed on the plurality of vanes, each of the plurality of guide pins is provided within each of the coil springs, each of the plurality of coil springs provided for each of the guide pins composed of at least two coil springs jointed axially each other, and a slider is provided between the jointed coil springs and projects into insides of the jointed coil springs.

According to this configuration, since the slider projecting inside the divided coil springs is provided between the divided coil springs, contacting between the coil springs and the guide pin can be prevented by the slider. Therefore, attrition and breakage of the coil springs can be prevented.

In addition, it is preferable that a spacer is provided between each of the plurality of coil springs and each base end of the plurality of vanes or between each of the plurality of coil springs and each bottom of the plurality of vane slots.

According to this configuration, contacting between the guide pin and at least one of the divided coil springs can be prevented by the spacer. Therefore, attrition and breakage of the at least one end of the divided coil springs can be prevented.

Meantime, since an inner circumference at the middle of the coil spring contacts with the guide pin when the coil spring serpentines in the vane pump disclosed in the Patent Document 2, the middle of the coil spring may be worn away. In addition, stress is applied to the coil springs according to its expansion and compression. Especially, since stress is focused on the inner circumference, fatigue breakage may occur due to attrition of the inner circumference. Prevention of fatigue breakage of the coil springs is further desired.

Therefore, it is preferable that the plurality of the guide pins is directly fixed on the rotor and the plurality of guide holes is formed on the plurality of vanes, each of the plurality of guide pins is provided within each of the coil springs, and each of the plurality of coil springs includes a zero-pitch portion, at which a winding pitch is made zero, at middle thereof along an axial direction thereof.

According to this configuration, an inner circumference of the zero-pitch portion contacts with the guide pin when the coil spring serpentines. However, since spring wire is contiguous each winding at the zero-pitch portion, stress is not applied thereto when the coil spring is compressed. Therefore, attrition of the zero-pitch portion may occur but fatigue breakage thereof does not occur.

In addition, it is preferable that an inner diameter of the zero-pitch portion is made smaller than an inner diameter of other portions except for the zero-pitch portion.

According to this configuration, the zero-pitch portion with a smaller inner diameter contacts with the guide pin firmly when the coil spring is compressed and thereby contacting between the guide pin and the other portions except for the zero-pitch portion can be prevented. As a result, fatigue breakage of the coil spring can be prevented firmly.

Meantime, the guide pins are attached onto the bottom of the vane slots via the support plates in the vane pump disclosed in the Patent Document 2. At this time, the guide pins should be fixed with high accuracy in order to prevent contacting with the vanes. However, since the vane slot is deep and narrow, it is very hard in terms of accuracy and reliability to fix onto the bottom of the deep and narrow vane slot with high accuracy. In addition, it is also hard to check a position and uprightness after fixing the guide pin. It is further desired to done manufacturing, fixing and checking works for the guide pins more easily.

Therefore, it is preferable that the plurality of the guide pins is directly fixed on the plurality of the vanes and the plurality of guide holes is formed on the rotor, and each of the plurality of guide pins is provided within each of the coil springs.

According to this configuration, with respect to manufacturing and fixing works for the guide pins, a work needed to be done within the vane slot is only a work providing the guide hole which does not need high accuracy. In addition, checking work after fixing the guide pins can be done before setting the vanes, onto which the guide pins had been already fixed, in the vane slots. Therefore, manufacturing, fixing and checking works for the guide pins can be done more easily.

In addition, it is preferable that each of the coil springs has a length capable of guiding an entire length of each of the plurality of guide pins when each of the plurality of vanes projects most.

According to this configuration, since serpentine flections of the coil springs are always prevented by the guide pins, the coil springs never be stuck between the rotor and the vanes.

Further, it is preferable that each of the plurality of coil springs are accommodated in an accommodating space provided in the rotor and an inequality $(b1-a)<(c-b2)$ is met. Here, each outer diameter of the plurality of the guide pins shall be a, each inner diameter of the plurality of coil springs shall be b1 and each outer diameter thereof shall be b2, and an inner diameter of the accommodating space shall be c.

According to this configuration, the coil springs do not contact with surrounding inner walls when serpentine flections of the coil springs are prevented by the guide pins. Therefore, the coil springs can be expanded and compressed smoothly.

Furthermore, it is preferable that the plurality of guide pins is press-fitted onto the plurality of vanes.

According to this configuration, the guide pins are fixed onto the vanes easily with high accuracy.

DETAILED DESCRIPTION OF THE EMBODIMENT

Hereinafter, embodiments of the prevent invention will be explained with reference to diagrams. First, a first embodiment will be explained with reference to FIGS. 1 to 3.

Figure 1:
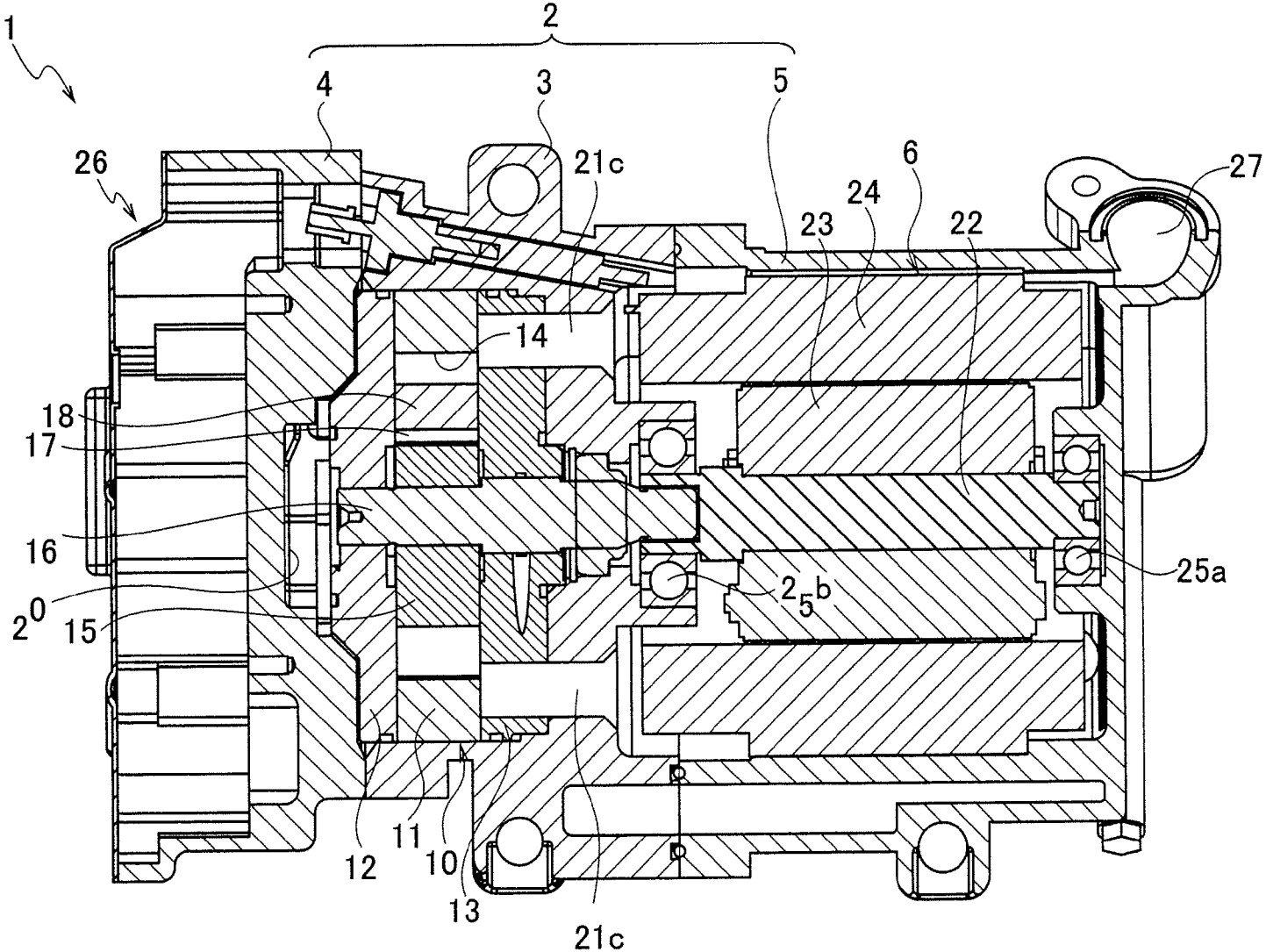
FIG. 1 is a cross-sectional diagram showing a vane-type compressor in embodiments according to the present invention.

As shown in FIG. 1, a compressor 1 includes a housing 2. The housing 2 is configured with an almost tubular compressor housing 3, a front housing 4 provided on one opening end of the compressor housing 3 and a motor housing 5 provided on another opening end of the compressor housing 3. The compressor housings 3, the front housing 4 and the motor housing 5 are all made of aluminum alloy.

A compression unit 10 is accommodated within the compressor housing 3. The compression unit includes a cylinder block 10, a front block 12 and a rear block both provided besides the cylinder block 11. These blocks 11, 12 and 13 are fixed each other by bolts 10*a* (see FIG. 2). A compression chamber 14 is formed within the blocks 11, 12 and 13. The blocks 11, 12 and 13 are made of aluminum alloy similarly to the housings 3, 4 and 5.

Figure 2:
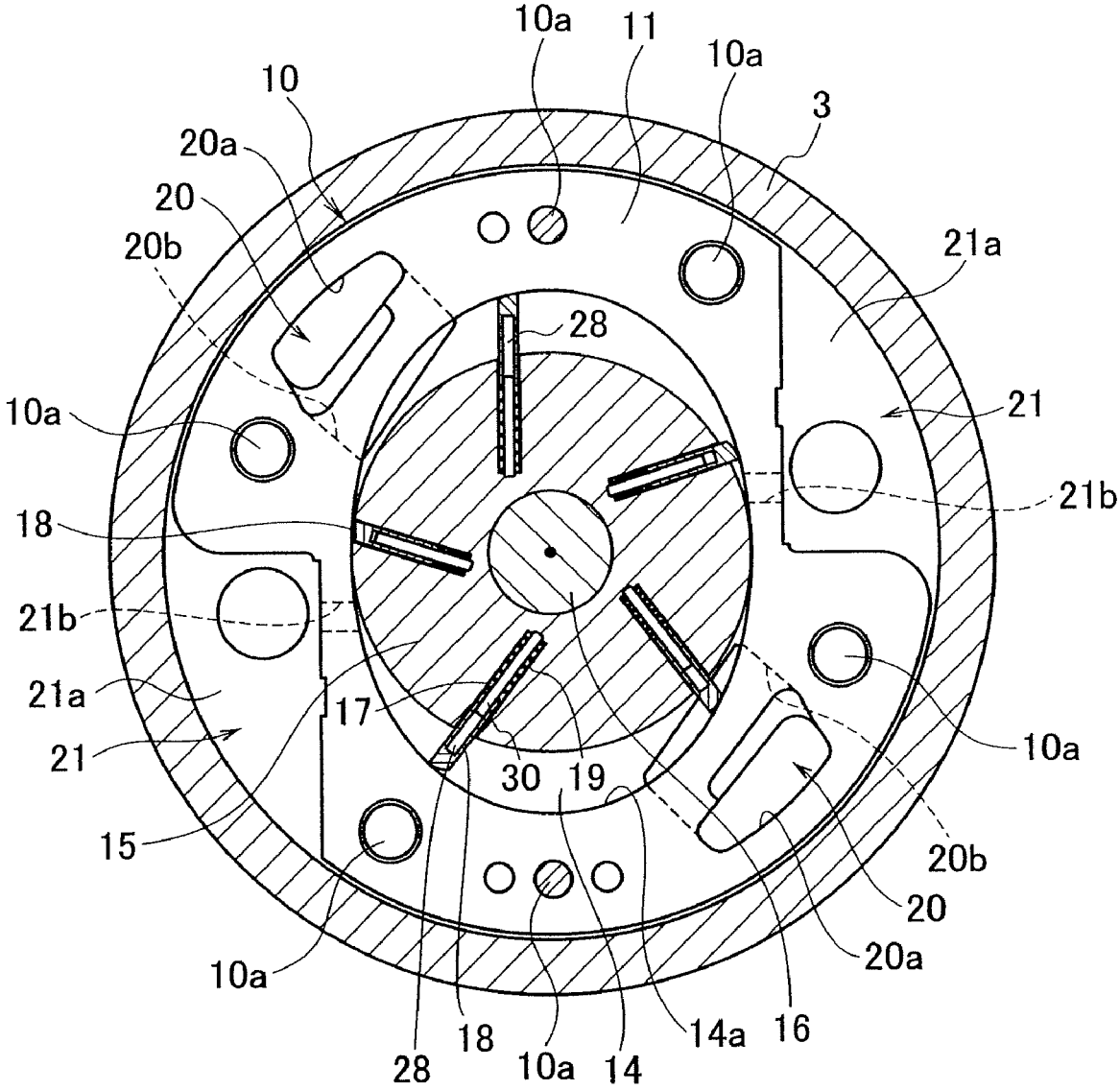
FIG. 2 is a cross sectional diagram of a compression unit in the compressor shown in FIG. 1.

As shown in FIG. 2, a circular rotor 15 is accommodated within the ellipsoidal compression chamber 14. A rotor axis 16 penetrates the center of the rotor 15 and is fixed with the rotor 15. The rotor axis 16 is rotatably supported by the front block 12 and the rear block 13. The rear end of the rotor axis 16 projects outward from the rear block 13.

Vane slots 17 are provided on the outer circumference of the rotor 15 at even intervals and extend in radial directions. A vane 18 is provided within each of the vane slots 17 and is capable of reciprocating within each of the vane slots 17. A refrigerant supply path (not shown) is opened at each bottom of the vane slots 17. (Note that additional high-pressure supply paths are not provided in the present embodiment.) Each of the vanes 18 is urged outward in its projecting direction by both back pressure due to the supplied refrigerant and elastic restoring force of a coil spring 19 (see FIG. 3). As rotating speed of the rotor 15 arises, a centrifugal force applied to each of the vanes 18 also urge it outward in the projecting direction. The vanes 18 reciprocate within the vane slots 17 with being contacted with an inner wall (a cam face) 14*a* of the compression chamber 14 by the above urging force in the projecting direction during the rotor axis 16 rotating. The compression chamber 14 is sectioned into plural chambers by the vanes 18. Each of the sectioned chambers repeats an intake process to intake refrigerant therein by enlarging its inner volume and a compression process to compress and discharge the refrigerant by reducing its inner volume.

Intake paths 20 are provided in the cylinder block 11 and so on and located at two positions opposed across the rotor axis 16. Each of the intake paths 20 includes an intake chamber 20*a* and an intake opening 20*b* communicating the intake chamber 20*a* and the compression chamber 14. Discharge paths 21 are also provided in the cylinder block 11 and so on and located at two positions opposed across the rotor axis 16. Each of the discharge paths 21 includes a discharge chamber 21*a* and a discharge opening 21*b* communicating the discharge chamber 21*a* and the compression chamber 14.

As shown in FIG. 1, a motor 6 is accommodated within the motor housing 5. The motor 6 includes a rotor 23 fixed with a motor axis 22 and a stator 24 fixed on an inner circumferential surface of the motor housing 5. Both ends of the motor axis 22 are rotatably supported by the motor housing 5 and the rear block 13 via ball bearings 25*a* and 25*b*. One end of the motor axis 22 is connected with the rotor axis 16. The rotor 23 is magnetized with north and south magnetic poles alternately along its circumferential direction. The stator 24 is configured with a core (not shown) made of ferromagnetic material and a coil (not shown) wound around the core. Driving current is supplied to the coil by a motor controller 26 configured with an inverter and so on. The motor controller 26 is installed on the front housing 4.

Rotation of the motor 6 is transmitted from the motor axis 22 to the rotor axis 16 and then the rotor 15 is rotated. The refrigerant compressed within the compression chamber 14 due to the rotor 15 rotating is sent into the motor housing 6 via discharge holes 21*c*. Oil included in the refrigerant is separated by an oil separator after the refrigerant has cooled the rotor 23 and the stator 24 and then the refrigerant is discharged outside the compressor 1 from a discharge port 27. The discharged refrigerant is sent to a condenser and so on.

Figure 3:
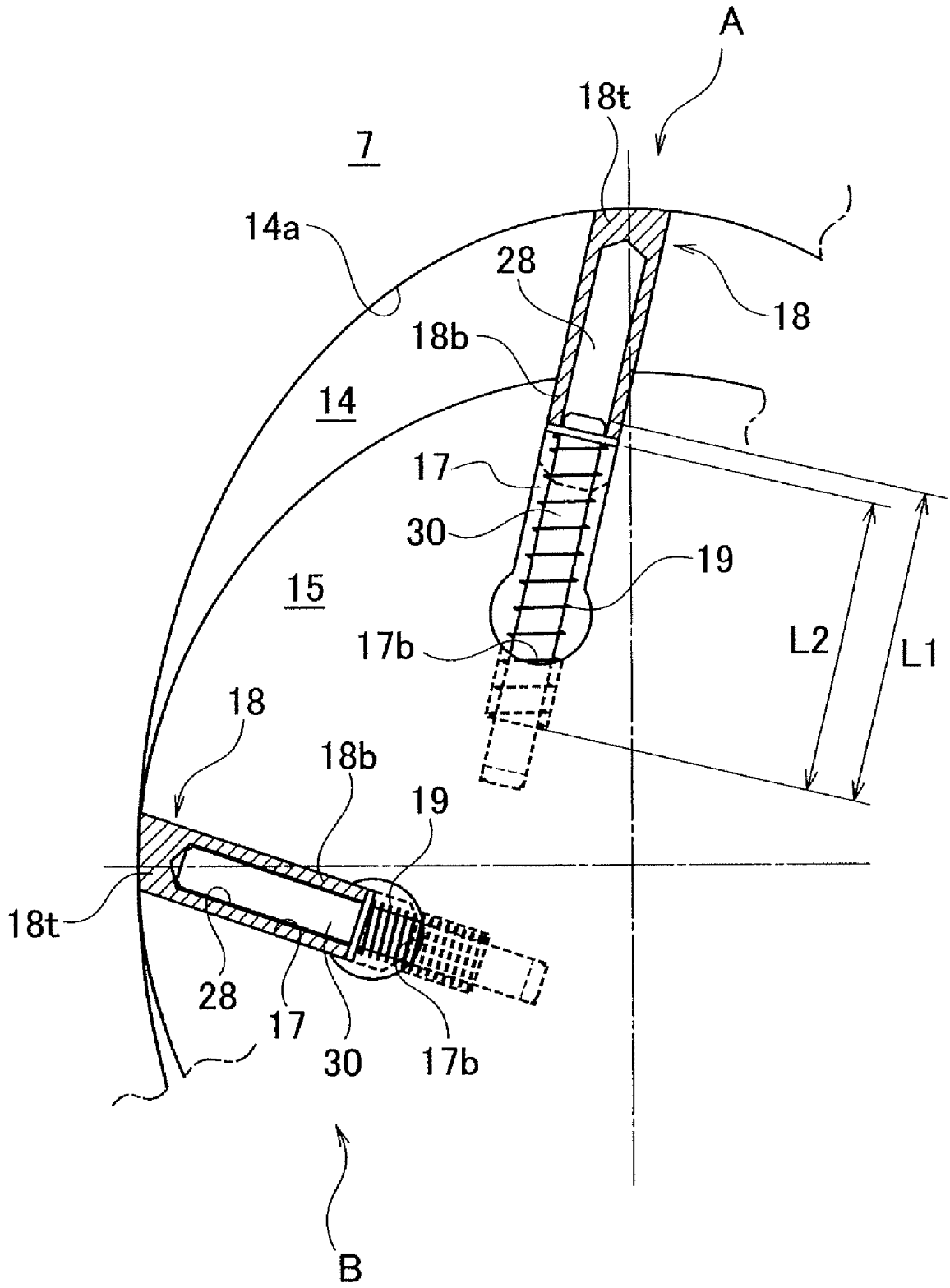
FIG. 3 is a cross-sectional diagram of vanes in a first embodiment according to the present invention.

As shown in FIG. 3, guide pins 30 are directly fixed on the bottoms of the vane slots 17. In the present embodiment, two guide pins 30 are press-fitted to be fixed onto each bottom of the vane slots 17. In addition, two guide holes 28 are formed on each of the vanes 18 to accommodate the reciprocating guide pins 30. Each of the guide pins 30 is inserted into each inside of the coil springs 19. As mentioned above, the coil springs 19 urges the vanes 18 outward to contact their top end edges onto the cam face 14*a*. One end of the coil spring 19 contacts with a bottom surface of the vane 18 and another end thereof contacts with the bottom of the vane slot 17. The guide pin 30 functions to prevent serpentine flection of the compressed coil spring 19. Since serpentine flections of the coil springs 19 are prevented, the coil springs 19 never are stuck between the bottoms of the vane slots 17 and the bottom surfaces of the vanes 18.

A condition indicated by an arrow A in FIG. 3 shows a condition where a projecting amount of the vane 18 from the vane slot 17 is maximum (an expanded condition of the coil spring 19). A condition indicated by an arrow B in FIG. 3 shows a condition where entire of the vane 18 is accommodated within the vane slot 17 (a compressed condition of the coil spring 19). An inner diameter of the guide hole 18 is made smaller than an outer diameter of the coil spring 19, so that the coil spring 19 cannot enter the inside of the guide hole 18. Therefore, a base end 18*a* of the vane 18 always contacts with the one end of the coil spring 19. In addition, the inner diameter of the guide hole 18 is made slightly larger than an outer diameter of the guide pin 30. The guide pin 30 is always inserted within the guide hole 28 at least partly.

The coil spring 19 presses the vane 18 so as to contact the top end 18*t* of the vane 18 onto the cam face 14*a* along with the rotor 15 rotating. In addition, the vane 18 is pressed back toward the inside of the vane slot 17 by a reaction force received from the cam face 14*a*. A position of the vane 18 varies between the above-mentioned conditions A and B to reciprocate within the vane slot 17.

In the condition A where the coil spring 19 is expanded most, misalignment of the coil spring 19 is prevented by the guide pin 30 being longer than the coil spring 19. In addition, in the condition A, a projecting amount of the vane 18 is maximum, so that chattering of the vane 18 hardly occurs. Further, since a load by the coil spring 19 is minimum, it is preferable in terms of friction reduction between the vane 18 and the cam face 14*a* and attrition reduction. Furthermore, the coil spring 19 is sufficiently long so as not to occur a play (gap) between the vane 18 and the coil spring 19 even when the projecting amount is maximum.

In the condition B where the coil spring 19 is compressed most, an inserted amount of the vane 18 into the vane slot 17 is maximum and thereby chattering of the vane 18 tends to occur. However, since the load by the coil spring 19 is maximum, chattering of the vane 18 is prevented. In addition, though the coil spring 19 is made compressed most, its serpentine flection is prevented by the guide pin 30. Further, stuck of the coil spring 19 due to its serpentine flection is also prevented.

As explained above, the vanes 18 are pressed toward the cam face 14 by the coil springs 19 for prevention of chattering in order to assist the back pressure in the vane slots 17. Therefore, it is not necessary to add additional high-pressure supply paths and spring-driven valves. As a result, a complex structure and cost rise are prevented.

In addition, serpentine flection of the coil springs 19 and stuck of the coil springs 19 due to the serpentine flection can be prevented by the guide pins 30.

Further, since the guide pins 30 is longer than the expanded coil springs 19, the coil spring 19 never be misaligned when they are expanded most as in the conventional vane pump.

Furthermore, since the guide pins 30 are press-fitted to be fixed onto the bottoms 17*b* of the vane slots 17, any extra component is not necessary to fix the guide pins as in the conventional vane pump. Therefore, component incrementation and cost rise can be prevented.

Next, a second embodiment will be explained with reference to FIGS. 4A and 4B. Note that a general configuration of the compressor 1 is the same as that in the first embodiment (see FIGS. 1 and 2) and thereby redundant explanations will be omitted. Configurations around vanes (especially, coil springs) are different between the present embodiment and the first embodiment.

Figure 4A:
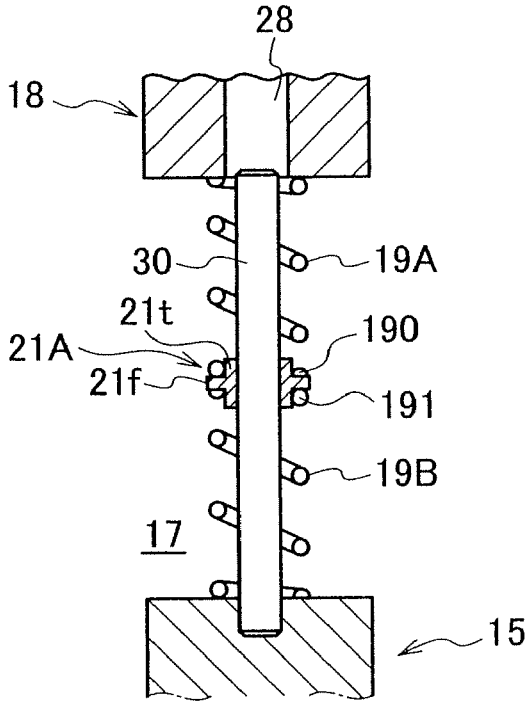
FIG. 4A is a cross-sectional diagram showing an environment of vanes (at coil springs being expanded) in a second embodiment according to the present invention.
Figure 4B:
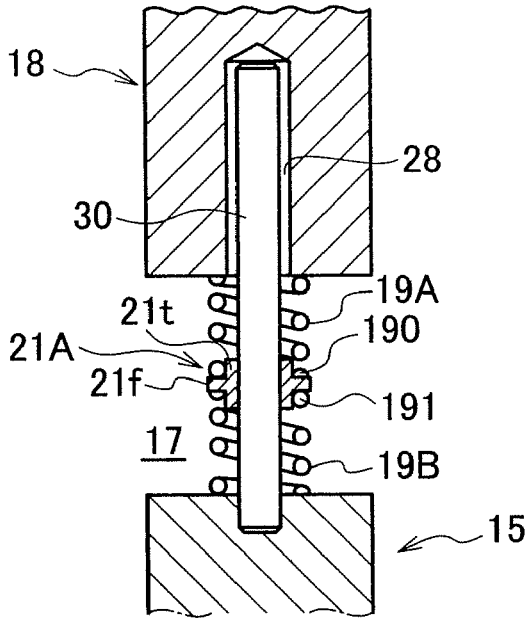
FIG. 4B is a cross-sectional diagram showing an environment of vanes (at coil springs being compressed) in the second embodiment according to the present invention.

As shown in FIGS. 4A and 4B, the guide pins 30 are press-fitted onto the bottoms of the vane slots 17. A projecting length of the guide pin 30 from the bottom is longer than a total length of expanded coil springs 19A, 19B and a slider 21A. The slider 21A is composed of a tubular element 21*t* inserted into the coil springs 19A, 19B and a flange 21*f* extended outward from the tubular element 21*t*. An outer diameter of the tubular element 21*t* is slightly smaller than each inner diameter of the coil springs 19A, 19B. The coil springs 19A, 19B have the same length. Each of opposed end of the coil springs 19A, 19B is received by the flange 21*f*. The slider 21A is sandwiched between the coil springs 19A, 19B to prevent the coil springs 19A, 19B from contacting with the guide pin 30.

FIG. 4A shows a condition where a projecting amount of the vane 18 is maximum (an expanded condition of the coil springs 19A, 19B). FIG. 4B shows a condition where entire of the vane 18 is accommodated within the vane slot 17 (a compressed condition of the coil springs 19A, 19B). The guide hole 28, into which the guide pin 30 is inserted, is provided in the vane 18. The inner diameter of the guide hole 28 is slightly larger than the outer diameter of the guide pin 30. In addition, the inner diameter of the guide hole 28 is smaller than the outer diameter of the coil spring 19A and the bottom surface of the vane 18 contacts with an end of the coil spring 19A.

A position of the vane 18 varies between the above-mentioned conditions shown in FIGS. 4A and 4B to reciprocate within the vane slot 17 with the rotor 15 rotating. At this time, the slider 21A (the tubular element 21*t*) reciprocates along the guide pin 30 along with expansion and compression of the coil springs 19A, 19B. This reciprocation of the tubular element 21*t* is done with sliding on the outer surface of the guide pin 30, so that the coil springs 19A, 19B never contacts with the guide pin 30.

In the condition shown in FIG. 4A where the coil springs 19A, 19B are expanded most, misalignment of the coil springs 19A, 19B is prevented by the guide pin 30 being longer than the total length of the coil springs 19A, 19B. In addition, a projecting amount of the vane 18 is maximum, so that chattering of the vane 18 hardly occurs. Further, since a load by the coil springs 19A, 19B is minimum, it is preferable in terms of friction reduction between the vane 18 and the cam face 14*a* and attrition reduction. Furthermore, the total length of the coil springs 19A, 19B is sufficiently long so as not to occur a play (gap) between the vane 18 and the coil springs 19*a*, 19B even when the projecting amount is maximum.

In the condition shown in FIG. 4B where the coil springs 19A, 19B are compressed most, an inserted amount of the vane 18 into the vane slot 17 is maximum and thereby chattering of the vane 18 tends to occur. However, since the load by the coil springs 19A, 19B is maximum, chattering of the vane 18 is prevented. In addition, serpentine flection of the coil springs 19*a*, 19B hardly occur because each length of the coil springs 19A, 19B is made short due to arrangement of the slider 21A. As a result, it is prevented that the coil springs 19A, 19B contacts with the guide pin 30 due to their serpentine flections.

As explained above, contacts between the coil springs 19A, 19B and the guide pin 30 is prevented by the slider 21A. Therefore, alteration of spring constant or breakage of the coil springs 19A, 19B due to their attrition is prevented. In addition, attrition of the guide pin 30 is also prevented.

In addition, since the slider 21A is arranged between the even-length coil springs 19A, 19B (at a position where they tends to contact with the guide pin 30), their contacts with the guide pin 30 are prevented more effectively.

Further, the coil spring 19 is divided into the two coil springs 19A, 19B by arranging the slider 21A. Therefore, each length of the coil springs 19A, 19B is made short and thereby their serpentine flections are prevented. As a result, their contacts with the guide pin 30 due to the serpentine flections are prevented.

Furthermore, the projecting length of the guide pin 30 from the bottom of the vane slot 17 is made longer than the total length of the coil springs 19A, 19B and the slider 21A (the flange 21*f*). Therefore, the coil springs 19*a*, 19B is guided firmly by the guide pin 30 even when they are expanded most and thereby their contacts with the inner wall of the vane slot 17 due to their serpentine flections are prevented.

Furthermore, since chattering of the vane 18 is prevented by the coil springs 19A, 19B, it is not necessary to provide high-pressure supply paths or spring-driven valves. As a result, a complex structure and cost rise can be prevented.

Furthermore, since the guide pins 30 are press-fitted onto the bottoms of the vane slots 17, any extra component (such as the support plate) is not necessary to fix the guide pins 30. As a result, component incrementation and cost rise can be prevented.

Figure 5A:
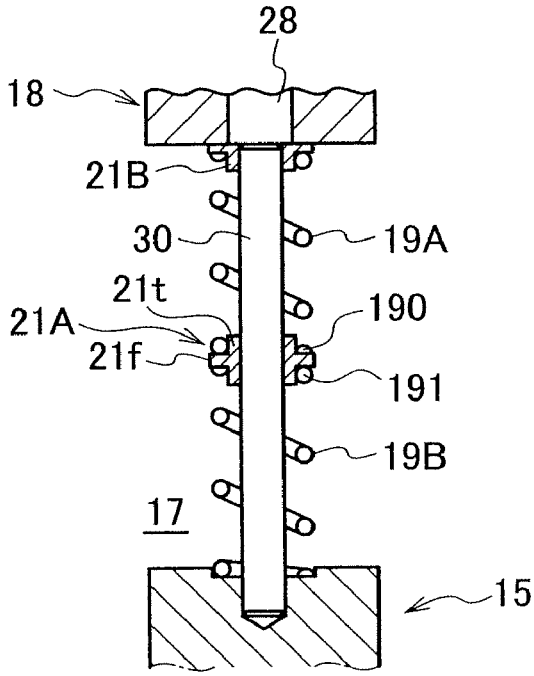
FIG. 5A is a cross-sectional diagram showing an environment of vanes (at coil springs being expanded) in a first modified example of the second embodiment according to the present invention.
Figure 5B:
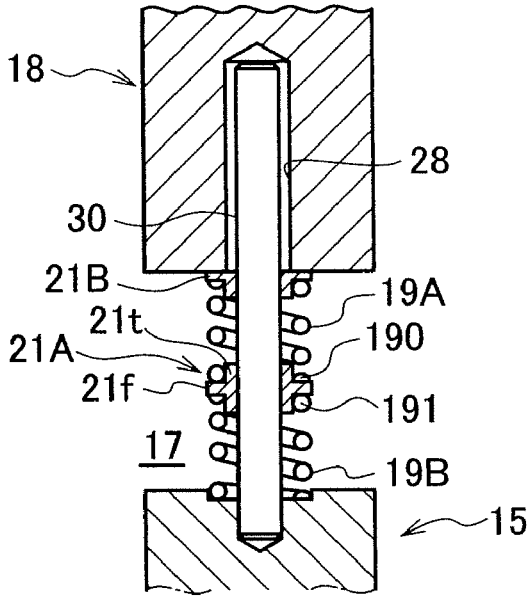
FIG. 5B is a cross-sectional diagram showing an environment of vanes (at coil springs being compressed) in the first modified example of the second embodiment according to the present invention.

A first modified example of the second embodiment is shown in FIGS. 5A and 5B.

In the first modified example, a spacer 21B is provided between another end of the coil spring 19A and the bottom surface of the vane 18. The spacer 21B projects toward the inside of the coil spring 19A.

According to the first modified example, compared with the above second embodiment, contacts between the other end of the coil spring 19A and the guide pin 30 can be prevented. Therefore, attrition and breakage of the other end (movable end in relation to the guide pin 30) of the coil spring 19A can be prevented.

Figure 6A:
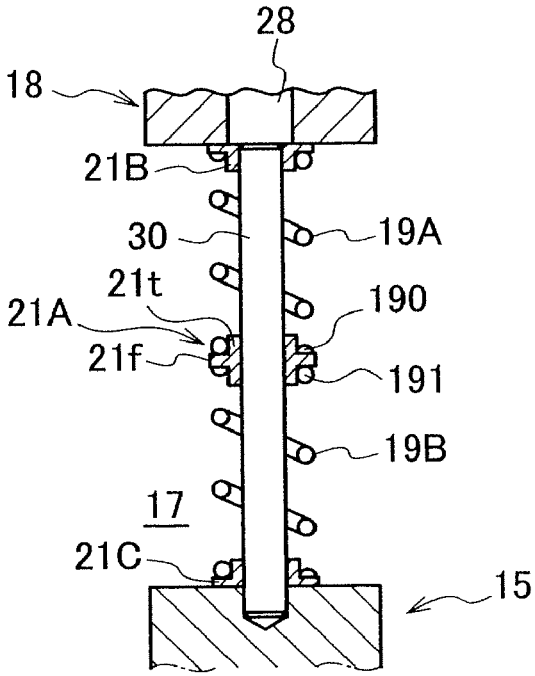
FIG. 6A is a cross-sectional diagram showing an environment of vanes (at coil springs being expanded) in a second modified example of the second embodiment according to the present invention.
Figure 6B:
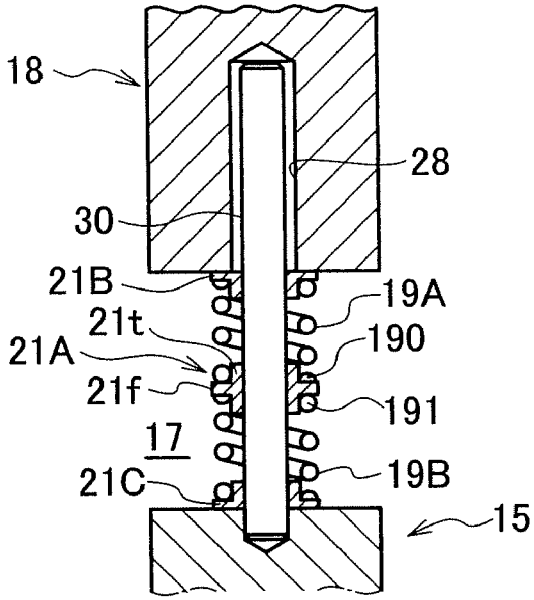
FIG. 6B is a cross-sectional diagram showing an environment of vanes (at coil springs being compressed) in the second modified example of the second embodiment according to the present invention.

A second modified example of the second embodiment is shown in FIGS. 6A and 6B.

In the second modified example, the spacer 21B and a spacer 21C are provided between the other end of the coil spring 19A and the bottom surface of the vane 18 and between the other end of the coil spring 19B and the bottom of the vane slot 17. The spacers 21B and 21C project toward the insides of the coil springs 19A, 19B, respectively.

According to the second modified example, compared with the above second embodiment, contacts between the other ends of the coil springs 19A, 19B and the guide pin 30 can be prevented. Therefore, attrition and breakage of the other ends (movable end and fixed end in relation to the guide pin 30) of the coil springs 19A, 19B can be prevented.

Note that three or more coil springs may be used for each guide pin. In addition, coil springs for one guide pin may have different lengths and two or more slider may be provided for each guide pin.

Next, a third embodiment will be explained with reference to FIGS. 7A and 7B. Note that a general configuration of the compressor 1 is the same as that in the first embodiment (see FIGS. 1 and 2) and thereby redundant explanations will be omitted. Configurations around vanes (especially, coil springs) are different between the present embodiment and the first embodiment.

Figure 7A:
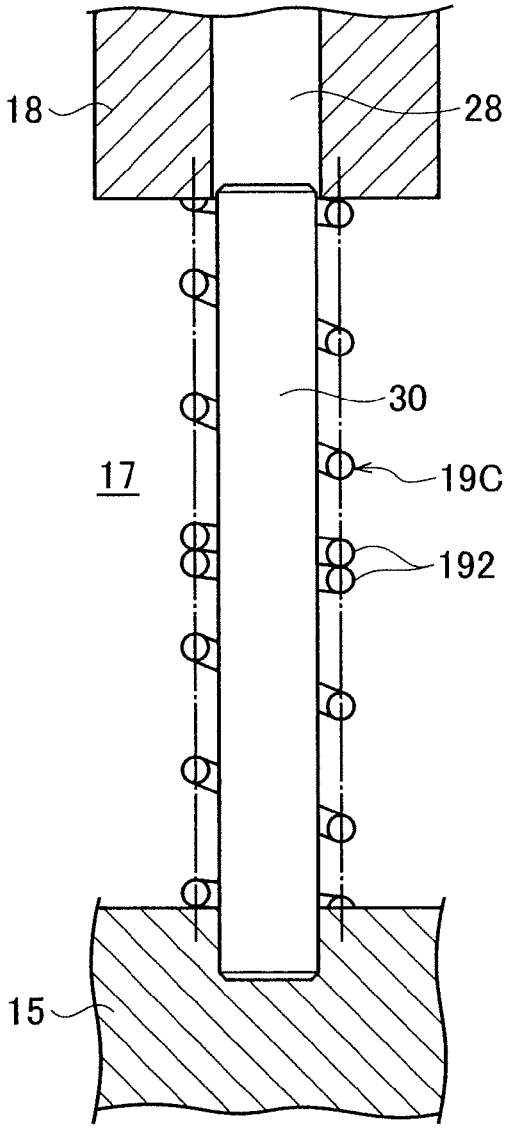
FIG. 7A is a cross-sectional diagram showing an environment of vanes (at coil springs being expanded) in a third embodiment according to the present invention.
Figure 7B:
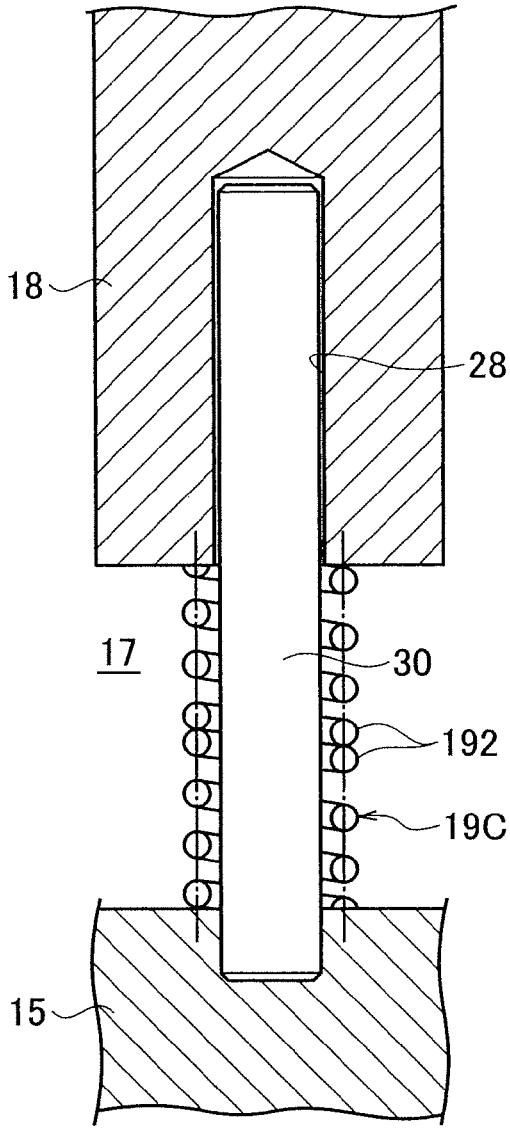
FIG. 7B is a cross-sectional diagram showing an environment of vanes (at coil springs being compressed) in the third embodiment according to the present invention.

As shown in FIGS. 7A and 7B, the guide pins 30 are press-fitted onto the bottoms of the vane slots 17. The guide pins 20 stand within the vane slots 17.

The guide holes 28 are provided on the bottom surface of the vanes 18. The vanes 18 can reciprocate so that the guide pins 30 are inserted into the guide holes 28.

The guide pin 30 is inserted into a coil spring 19C. one end of the coil spring 19C contacts with the bottom surface of the vane 18 and another end thereof contacts with the bottom of the vane slot 17. the coil spring 19C has a zero-pitch portion 192, at which a winding pitch of a spring wire is made zero, at its middle along its axial direction. The zero-pitch portion 192 is formed by attaching the wound spring wire each winding due to a winding device setting.

The rotor 15 rotates on the motor 6 being driven and some of the refrigerant compressed by the vanes 18 within the compression chamber 14 is supplied to the refrigerant supply paths (not shown) provided at the bottoms of the vane slots 17. Therefore, back pressure by the refrigerant is supplied to the base ends of the vanes 18, so that the vanes 18 are urged in the projecting direction by the back pressure and the elastic restoring forces of the coil springs 19C. Since a load by the coil spring 19C is applied to the vane 18 even at starting of compression when the back pressure can not be applied, chattering of the vane 18 never occurs.

In addition, the coil spring 19C repeats its expansion and compression along with the vane 18 reciprocating while the compression unit 10 being driven. If the coil spring 19C serpentines at its compression, an inner circumference of the zero-pitch portion 192 contacts with the guide pin 30. Therefore, the zero-pitch portion 192 may be worn away. However, since the spring wire is contacted each winding at the zero-pitch portion 192, stress is not supplied to the zero-pitch portion 192 due to the expansion and the compression. As a result, the zero-pitch portion 192 may be worn away but never brings its fatigue breakage.

Figure 8A:
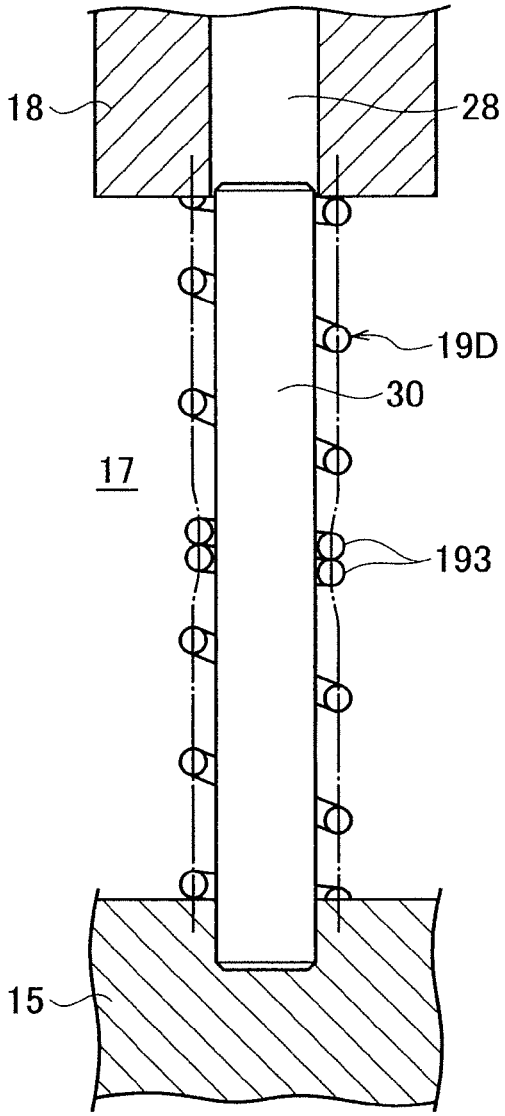
FIG. 8A is a cross-sectional diagram showing an environment of vanes (at coil springs being expanded) in a modified example of the third embodiment according to the present invention.
Figure 8B:
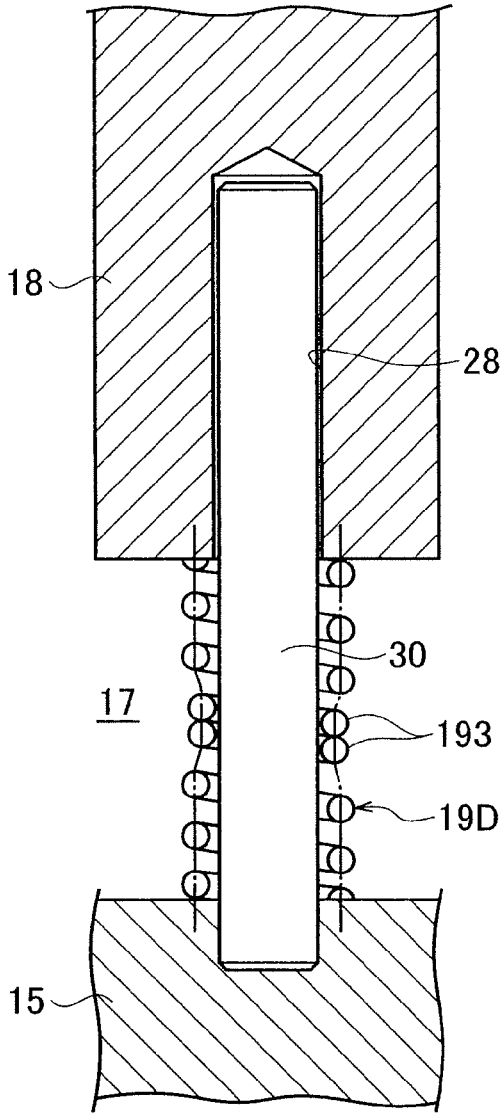
FIG. 8B is a cross-sectional diagram showing an environment of vanes (at coil springs being compressed) in the modified example of the third embodiment according to the present invention.

A modified example of the third embodiment is shown in FIGS. 8A and 8B.

In this modified example, an inner diameter of a zero-pitch portion 193 of a coil spring 19D is made smaller than an inner diameter of other portions (except for the zero-pitch portion 193).

According to this modified embodiment, the zero-pitch portion 193 having the smaller diameter contacts with the guide pin 30 firmly when the coil spring 19*d* serpentines, so that the other portions never contact with the guide pin 30. Therefore, fatigue breakage of the coil spring 19D can be prevented firmly.

Note that one zero-pitch portion 192 or 193 is provided at middle of the coil spring 19C or 19D in the third embodiment or its modified example. However, plural zero-pitch portions may be provided for each coil spring.

Next, a fourth embodiment will be explained with reference to FIGS. 9A and 11. Note that a general configuration of the compressor 1 is the same as that in the first embodiment (see FIGS. 1 and 2) and thereby redundant explanations will be omitted. Configurations around vanes (especially, coil springs and guide pins) are different between the present embodiment and the first embodiment.

As shown in FIGS. 9A to 10B, plural recesses 18*a* are formed on the bottom surface of the vanes 18. The guide pins 18 are press-fitted into the recesses 18*a*. Specifically, the guide pin 30 is directly fixed on the vane 18 by being press-fitted. The guide pin 30 has a length capable of covering the whole length of the coil spring 19 at the maximum projected position of the vane 18 (see FIGS. 9B and 10B).

A refrigerant supply path 31 is opened at the bottom of the vane slot 17. Refrigerant supplied through the refrigerant supply path 31 applies to the vane 18 as back pressure. In addition, guide holes 29 are opened on the bottom of the vane slots 17. The guide hole 29 composed of an accommodating space 29*a* opened on the bottom of the vane slot 17 and an inserted space 29*b* communicating with the accommodating space 29*a*. A step is made at the border between the accommodating space 29*a* and the inserted space 29*b*. An end of the coil spring 19 is received by the step.

The guide pin 30 is inserted into the coil spring 19. One end of the coil spring 19 contacts with the bottom surface of the vane 19 and another end thereof contacts with the above-mentioned step. In other words, the coil spring 19 is accommodated within the vane slot 17 and the accommodating space 29*a* of the guide hole 29.

Figure 11:
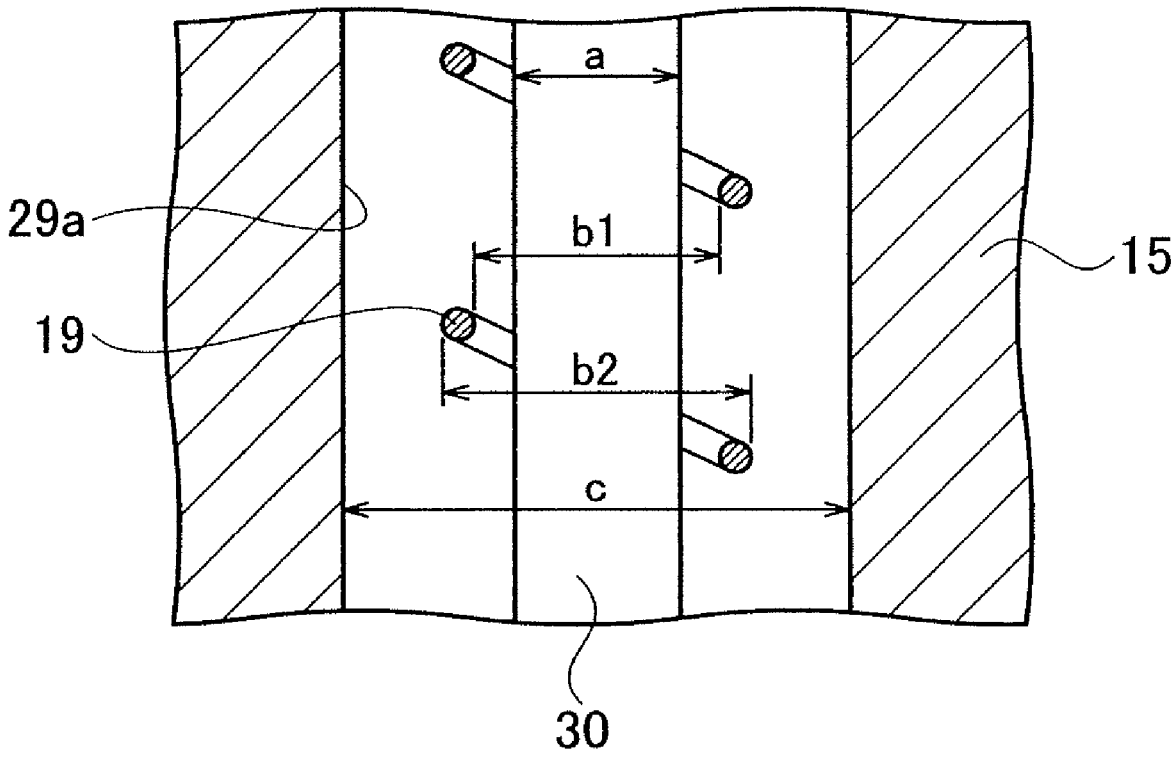
FIG. 11 is a side view showing dimensions of a guide pin and a coil spring in the fourth embodiment.

As shown in FIG. 11, when an outer diameter of the guide pin 30 shall be a, an inner diameter of the coil spring 19 shall be b1 and its outer diameter shall be b2, and an inner diameter of the accommodating space 29*a* shall be c, an inequality $(b1-a)<(c-b2)$ is met.

The rotor 15 rotates on the motor 6 being driven and some of the refrigerant compressed by the vanes 18 within the compression chamber 14 is supplied to the refrigerant supply paths 31. Therefore, back pressure by the refrigerant is supplied to the base ends of the vanes 18, so that the vanes 18 are urged in the projecting direction by the back pressure and the elastic restoring forces of the coil springs 19C. Since a load by the coil spring 19C is applied to the vane 18 even at starting of compression when the back pressure can not be applied, chattering of the vane 18 never occurs.

Since the guide pins 30 for guiding the coil springs 19 are directly fixed onto the vanes 18, a work needed to be done within the vane slot 17 is only a work providing the guide hole 29 which does not need high accuracy. In addition, checking work after fixing the guide pins 30 can be done before setting the vanes 18, onto which the guide pins 30 had been already fixed, in the vane slots 17. Therefore, manufacturing, fixing and checking works for the guide pins 30 can be done more easily.

Figure 9B:
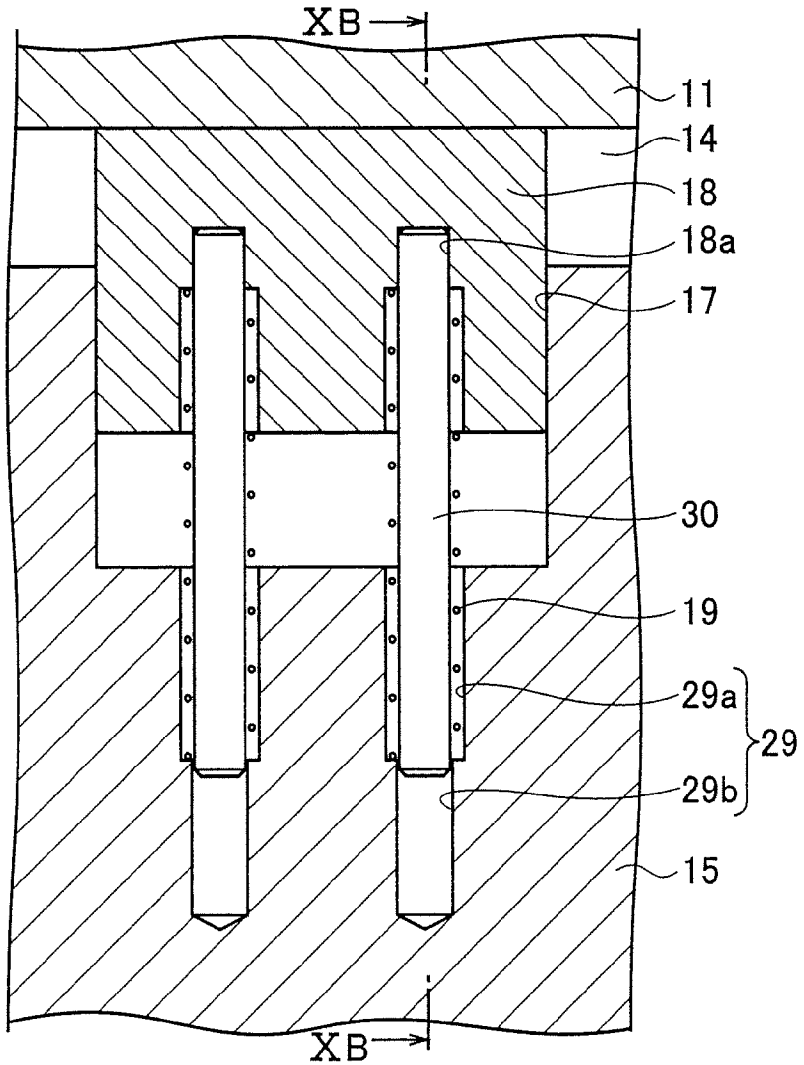
FIG. 9B is a cross-sectional diagram of the vane (being accommodated in a vane slot) in the fourth embodiment according to the present invention.
Figure 9A:
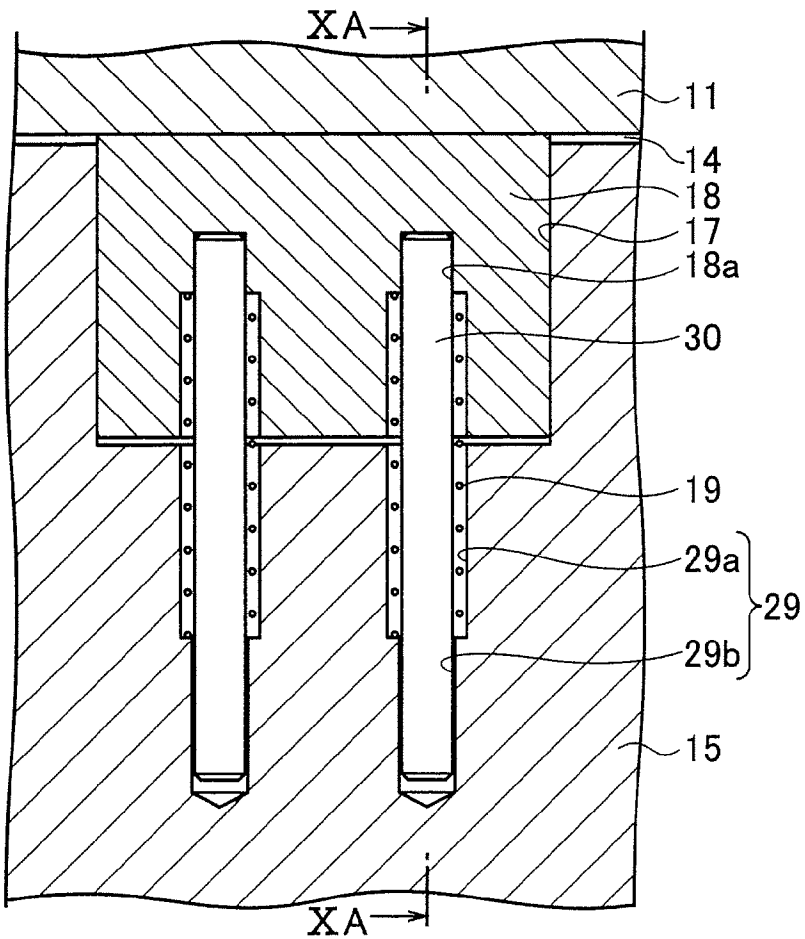
FIG. 9A is a cross-sectional diagram of a vane (being projected) in a fourth embodiment according to the present invention.
Figure 10B:
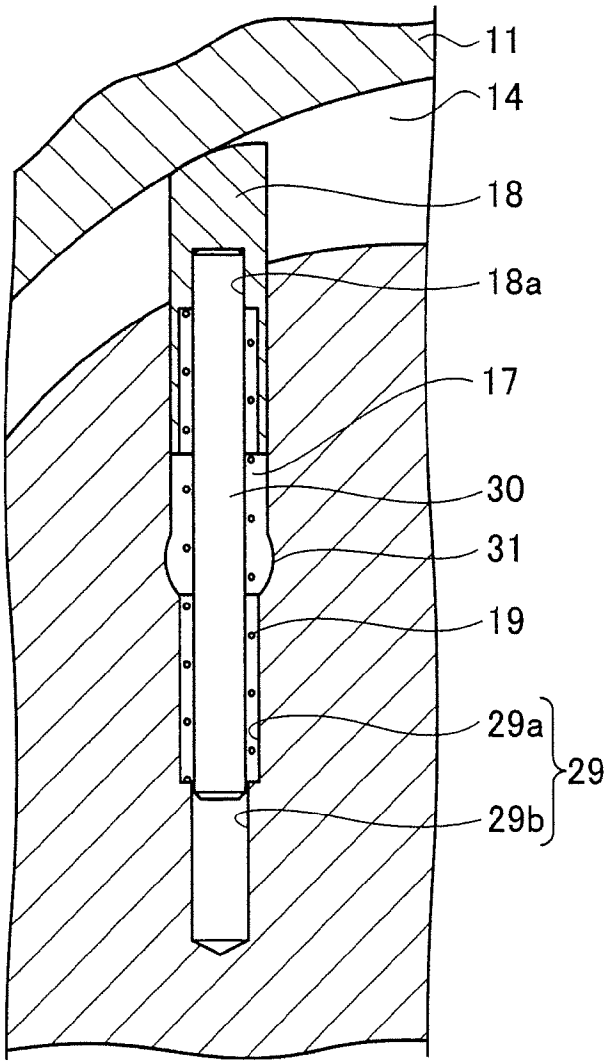
FIG. 10B is a cross-sectional diagram along a line XB-XB shown in FIG. 9B.
Figure 10A:
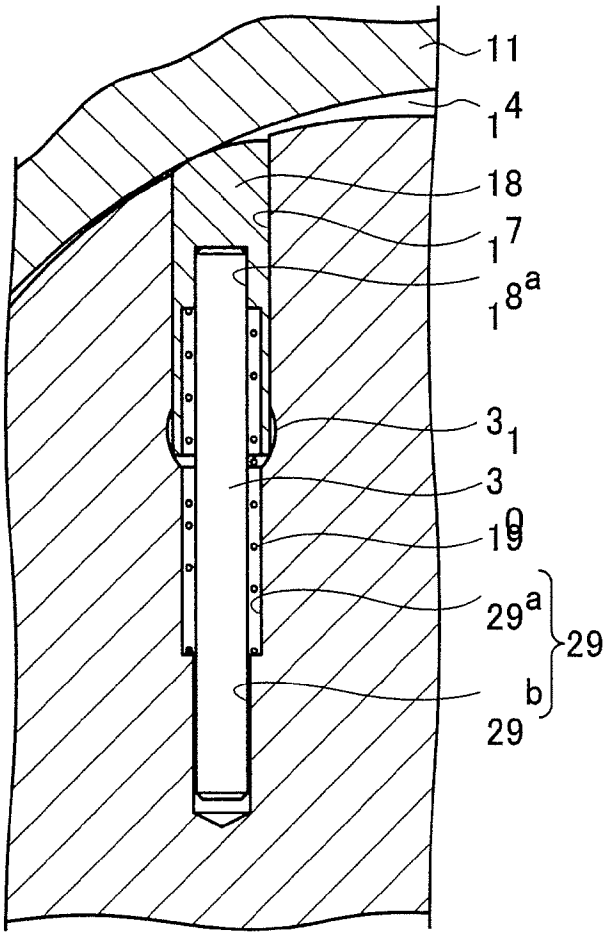
FIG. 10A is a cross-sectional diagram along a line XA-XA shown in FIG. 9A.

In the present embodiment, the guide pin 30 has the length capable of covering the whole length of the coil spring 19 at the maximum projected position of the vane 18 (see FIGS. 9B and 10B). Therefore, stuck of the coil spring 19 due to its serpentine flection can be prevented firmly.

In the present embodiment, the inequality (b1−a)<(c−b2) is met as explained above. Therefore, the coil spring 19 never contacts with an inner wall of the accommodating space 29*a* if the coil spring 19 serpentines. As a result, smooth expansion and compression of the coil spring 19 can be achieved.

In the present embodiment, the guide pins are directly fixed onto the vanes 18 by being press-fitted. Therefore, the guide pins 30 are easily fixed on the vanes 18 with high-accuracy. It is preferable that the guide pins 20 are press-fitted into the vanes 18. However, they may be directly fixed on the vanes 18 by screw-fixing, glue-fixing or the like. Alternatively, the vane 18 and the guide pins 30 may be formed integrally (for example, by grinding process).

Note that the vane-type compressor according to the present invention is not limited to the above embodiments and can be varied within the technical scope of the present invention.

In addition, the vane-type compressor according to the present invention can be applied to limited-slip differential device using high-viscosity oil as working fluid in a drive train for a vehicle other than the above-mentioned refrigerating system using refrigerant.

Further, a drive source of the vane-type compressor according to the present invention may be an internal combustion engine or the like other than the above electric motor. Furthermore, the drive source may not be unitized with the compressor as mentioned above. The compressor may be driven using a pulley.

This application claims priority from Japanese Patent Application Nos. 2007-332645, filed Dec. 25, 2007; 2008-013937 filed Jan. 24, 2008; 2008-051092 filed Feb. 29, 2008; and 2008-067743 filed Mar. 17, 2008, which are incorporated herein by reference in their entirety.

What is claimed is:

1. A vane compressor comprising:

a cylinder block;

a rotor rotating within the cylinder block;

a plurality of vane slots provided on an outer surface of the rotor and extending inwardly;

a plurality of vanes each provided slidably within each of the plurality of vane slots and reciprocating so as to contact a top end of the plurality of vanes onto an inner surface of the cylinder block along with the rotor rotating;

a plurality of coil springs provided within the plurality of vane slots for pushing the plurality of vanes toward the inner surface;

a plurality of guide pins each provided along each of the plurality of coil springs and directly fixed on the plurality of vanes; and a plurality of guide holes each provided for each of the plurality of guide pins and formed on the rotor, wherein:

each of the plurality of guide pins is provided within each of the plurality of coil springs, each of the plurality of guide pins has a length capable of guiding an entire length of each of the plurality of coil springs when each of the plurality of vanes projects most, each of the plurality of coil springs are accommodated in an accommodating space provided in the rotor, and an inequality (b1−a)<(c−b2) is met with each outer diameter of the plurality of the guide pins being a, each inner diameter of the plurality of coil springs being b1, each outer diameter of the plurality of coil springs being b2, and an inner diameter of the accommodating space being c.

2. The vane compressor according to claim 1, wherein the plurality of guide pins is press-fitted onto the plurality of vanes.

* * * * *